US006259210B1

(12) United States Patent
Wells

(10) Patent No.: US 6,259,210 B1
(45) Date of Patent: Jul. 10, 2001

(54) POWER CONTROL APPARATUS FOR AN ION SOURCE HAVING AN INDIRECTLY HEATED CATHODE

(75) Inventor: Stephen Wells, West Sussex (GB)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/462,264

(22) PCT Filed: Jul. 14, 1998

(86) PCT No.: PCT/GB98/02075

§ 371 Date: Mar. 15, 2000

§ 102(e) Date: Mar. 15, 2000

(87) PCT Pub. No.: WO99/04409

PCT Pub. Date: Jan. 28, 1999

(51) Int. Cl.[7] ..... H01J 7/24

(52) U.S. Cl. ..... 315/111.81; 315/111.41; 315/291; 315/224; 315/106; 250/423 R; 250/492.21

(58) Field of Search ..... 315/111.21, 111.41, 315/111.61, 111.81, 224, 291, 111.91, 307, 106, 107; 250/423 R, 426, 492.21, 427

(56) References Cited

U.S. PATENT DOCUMENTS

| | | | |
|---|---|---|---|
| 3,909,663 | 9/1975 | Thomas et al. | 315/106 |
| 4,506,160 | 3/1985 | Sugawara et al. | 250/427 |
| 4,578,589 | 3/1986 | Aitken | 250/492.2 |
| 4,743,767 * | 5/1988 | Plumb et al. | 250/492.2 |
| 4,754,200 | 6/1988 | Plumb et al. | 315/111.81 |
| 5,097,179 | 3/1992 | Takayama | 315/111.81 |
| 5,262,652 | 11/1993 | Bright et al. | 250/492.2 |
| 5,497,006 | 3/1996 | Sferlazzo et al. | 250/427 |

FOREIGN PATENT DOCUMENTS

0215626A2 3/1987 (EP) .

OTHER PUBLICATIONS

WPI Abstract Accession No. 96–257020 26 & JP 080106872 A (NISSHIN) 23–04–96.

* cited by examiner

*Primary Examiner*—Haissa Philogene
(74) *Attorney, Agent, or Firm*—Boult Wade Tennant

(57) ABSTRACT

In a power control apparatus for controlling power supply of an ion source having an indirectly headed cathode, the cathode bias power supply which provides a bias potential between the filament and cathode has an output that is effected by changes in impedance of the electron flow in the region between the filament and the cathode. Such impedance changes can arise due to changes in the chemistry of materials in this region, changes in gas pressure or physical changes, for example. A bias supply controller in the power control apparatus maintains the output power of the cathode bias power supply unit at a desired level, thus not effected by changes in impedance of the electron flow between the filament and the indirectly heated cathode.

16 Claims, 1 Drawing Sheet

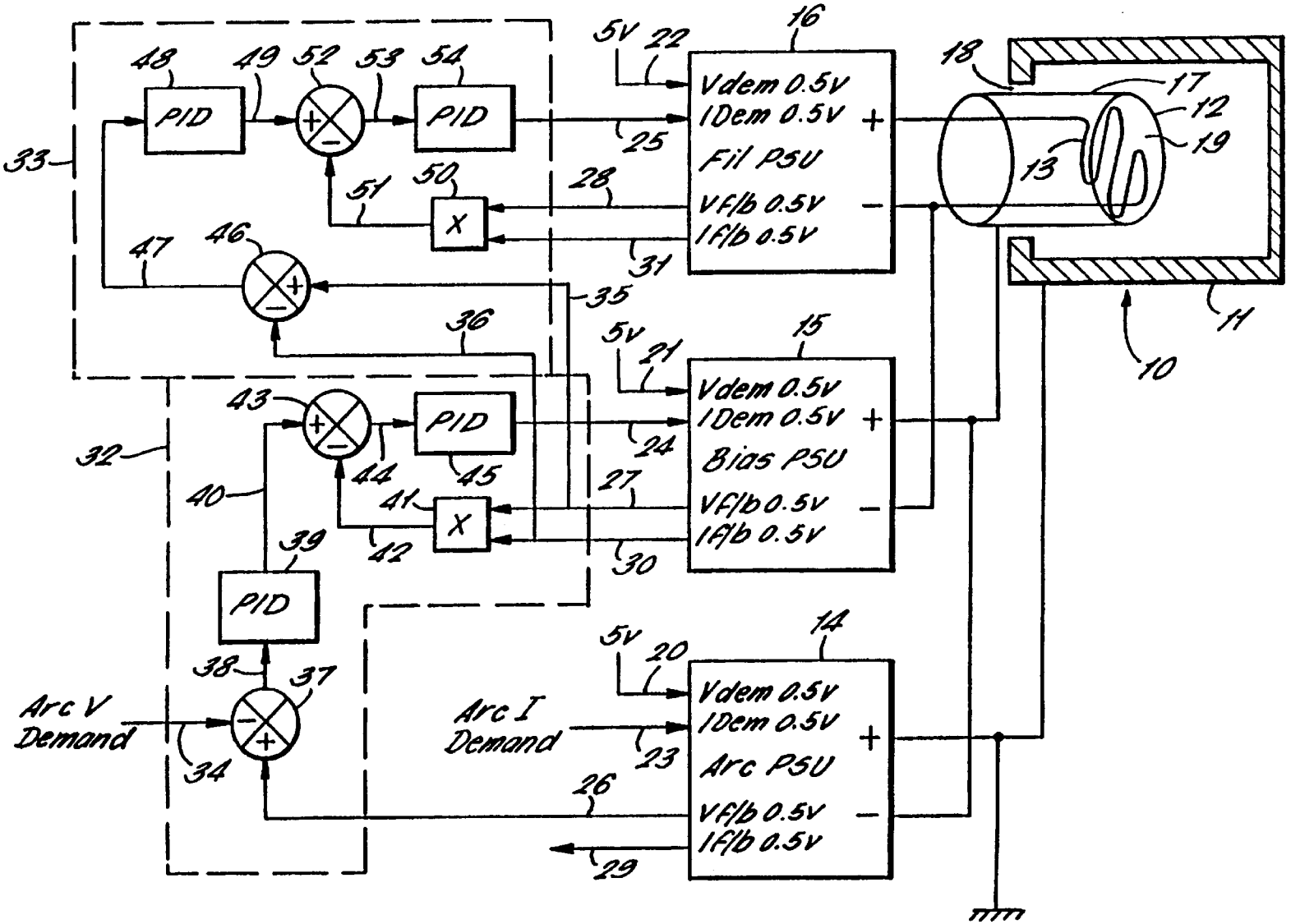
Vdem 0.5V
IDem 0.5V
Fil PSU
VFlb 0.5V
IFlb 0.5V
Vdem 0.5V
IDem 0.5V
Bias PSU
VFlb 0.5V
IFlb 0.5V
Vdem 0.5V
IDem 0.5V
Arc PSU
VFlb 0.5V
IFlb 0.5V
PID
X
Arc I Demand
Arc V Demand

POWER CONTROL APPARATUS FOR AN ION SOURCE HAVING AN INDIRECTLY HEATED CATHODE

This application is the national phase under 35 U.S.C. § 371 PCT International Application No. PCT/GB98/02075 which has an International filing date of Jul. 14, 1998, which designated the United States of America.

FIELD OF THE INVENTION

The present invention is concerned with power control apparatus for controlling the power supplies of an ion source having an indirectly heated cathode.

BACKGROUND OF THE INVENTION

Hot cathode ion sources are well known and include for example the so called Freeman ion source and the so called Bernas ion source. These ion sources include a filament cathode which is directly heated by passing a current through the filament from a filament power supply. The ion source comprises an arc chamber containing the filament and to which a supply of gas or vaporised material is supplied. Once the cathode filament has been heated sufficiently with the filament current, thermionic electrons are emitted by the cathode. If the cathode is held at a substantial negative potential relative to an anode electrode in the arc chamber, a plasma is formed in the arc chamber with an arc current flowing between the cathode and the anode electrode. Typically, the anode electrode is in fact formed by the walls of the arc chamber.

In the plasma so formed in the arc chamber, molecules of the feedstock gas or vapour are ionised and these positive ions are extracted from the arc chamber through an aperture by an extraction electrode held at a negative potential relative to the arc chamber. The extracted ions may then be used to form an ion beam which may have a number of applications. One important application is in ion beam implantation where beams of ions of desired dopant materials are directed at semiconductor substrates (wafers) in order to implant the dopant in the semiconductor to provide desired conductivity conditions.

A Freeman type ion source, especially for ion beam implantation apparatus, is disclosed in U.S. Pat. No. 4,578,589. The Freeman ion source includes a filament power supply to provide a heating current through the cathode filament, and an arc power supply. U.S. Pat. No. 4,754,200 discloses a method of controlling the power supplies to optimise performance of the ion source, especially in its application in an ion implantation apparatus.

U.S. Pat. No. 5,262,652 discloses a Bernas-type ion source in an ion implanter application. Again the Bernas-type source has a directly heated cathode filament with a filament power supply to provide a heating current through the filament, and a separate arc power supply to provide a desired arc potential between the filament and the anode or arc chamber body.

The above mentioned U.S. Pat. No. 4,754,200 discloses circuits for controlling the ion source power supplies. Thus, it is known to apply a constant arc voltage between the filament and the arc chamber body (or anode) and then to adjust the filament supply to achieve a desired arc current. It is also known to control the filament power supply by means of a power demand signal, i.e. to achieve an output power from the filament power supply in accordance with an input power demand signal, where the filament input power demand is derived from an error in the arc voltage, the arc current being held constant.

U.S. Pat. No. 5,497,006 discloses an ion source of the Bernas-type, but with an indirectly heated cathode. In this arrangement, the cathode in the arc chamber of the source is formed of an electrically conductive button-like member which is indirectly heated from a separate filament located behind the button on the opposite side relative to the main plasma chamber of the ion source. The source includes not only an arc power supply and a filament power supply, but also a cathode bias power supply which provides a required bias potential between the filament and the cathode button. In operation, the filament is biased negatively relative to the cathode button so that electrons thermionically emitted by the filament are accelerated to strike the rear face of the button, thereby heating the button cathode so that this cathode in turn emits electrons into the plasma chamber to initiate or maintain the plasma arc of the source.

This arrangement with an indirectly heated cathode in the ion source greatly extends the life of the ion source before it is necessary to change either the cathode itself or the cathode heater filament. The above form of ion source with an indirectly heated cathode will be referred to hereinafter as an indirectly heated cathode-type ion source as hereinbefore defined.

U.S. Pat. No. 5,497,006 discloses an ion source having a filament power supply unit, a cathode bias power supply unit and an arc power supply unit, and a power control apparatus for controlling these power supplies. In the U.S. specification, programmable power supply units are used for each of these supplies. The arc power supply unit is controlled to provide an output arc voltage in accordance with an input voltage demand level. The bias voltage applied between the cathode button and the filament by the cathode bias power supply unit is set in accordance with the difference between a desired arc current and the measured current delivered to the arc by the arc power supply, so as to minimise this difference. Thus, if the arc current is below the demand value, the cathode bias supply voltage is increased to increase the heating energy delivered to the cathode button, thereby to reduce the impedance of the plasma in the arc chamber and consequently to increase the arc current. The filament power supply in U.S. '006, is in turn controlled to keep the current delivered by the cathode bias power supply equal to a desired level of current. Thus, the current from the cathode bias power supply is maintained at a required demand level by increasing or decreasing the voltage applied by the filament power supply to the filament.

SUMMARY OF THE INVENTION

The present invention sets out to improve the way in which the various power supplies of an indirectly heated cathode-type ion source are controlled, to improve stability, to maximise source life, and to provide quick response especially in terms of control of the plasma arc of the source.

According to one aspect of the invention, power control apparatus for controlling power supplies of an indirectly heated cathode-type ion source as hereinbefore defined, having a filament power supply unit, a cathode bias power supply unit and an arc power supply unit, comprises a bias supply controller responsive to a difference between a parameter of the arc power supply and a demand value of said parameter to produce a bias power demand signal representing an output power of the bias power supply unit required to minimise said difference and is further responsive to said bias power demand signal to maintain said output power of said bias power supply unit at said required power.

Because the bias supply controller operates to maintain the output power of the cathode bias power supply unit at a required level, the power delivered to the cathode is not effected by changes in impedance of the cathode bias load, that is the impedance of the electron flow in the region between the filament and the indirectly heated cathode itself. Such impedance changes can arise due to changes in the chemistry of materials in this region, changes in gas pressure or physical changes, for example.

In prior art control arrangements, where for example, the output voltage of the cathode bias power supply is directly controlled, a change in the cathode bias load impedance produces a change in the cathode bias current, and therefore a change in the power delivered to the cathode from the cathode bias power supply unit. In the prior art arrangement disclosed in U.S. Pat. No. 5,497,006, this change in cathode bias power must be compensated for by adjusting the filament power supply in order to return the cathode bias current to a required value. With this arrangement of the invention the output power of the cathode bias power supply unit is directly controlled to match a demand value, so that a change in bias load impedance does not require external compensation to keep the power delivered to the bias load at the demand value.

The arc power supply parameter used to produce a bias power demand signal may be either the output voltage or the output current of the arc power supply unit, depending whether the primary control input to the arc power supply unit is an arc current demand signal or an arc voltage demand signal. Conveniently, the above power control apparatus is used with a cathode bias power supply unit which provides a bias voltage feedback signal representing the output voltage of the supply unit and a bias current feedback signal representing the output current of the supply unit, the bias supply controller then including a bias multiplier deriving a bias power feedback signal from the product of said bias voltage and bias current feedback signals, a bias power comparator deriving a bias power error signal from the difference between said bias power feedback signal and said bias power demand signal, and a bias power error conditioning filter, including an integrator, to condition said bias power error signal to apply as an output control signal to said cathode bias power supply unit, to control the output of the supply unit to reduce said bias power error signal. In this way, a relatively fast bias power control loop is formed which ensures that the output power supplied by the cathode bias power supply unit is maintained at the level determined by the bias power demand signal.

Also conveniently, said bias supply controller includes an arc parameter comparator deriving an arc parameter error signal from said difference between said arc parameter and said demand value of said arc parameter, and an arc parameter error conditioning filter, including an integrator, to condition said arc parameter error signal to provide said bias power demand signal.

The present invention also provides power control apparatus for controlling power supplies of an indirectly heated cathode-type ion source, as hereinbefore defined, having a filament power supply unit, a cathode bias power supply unit and an arc power supply unit, the apparatus comprising a filament supply controller responsive to an error in a parameter of the bias power supply relative to a desired value of said parameter to produce a filament power demand signal representing an output power of the filament power supply unit required to minimise said error and is further responsive to said filament power demand signal to maintain said output power of said filament power supply unit at said required power.

This filament power supply controller may be used either together or independently of the bias supply controller described above. The above described filament supply controller provides the advantage of ensuring that the power delivered to the filament is directly controlled and is therefore independent of changes in filament impedance, which tends to rise during the life of the filament.

In the example of the prior art described in U.S. Pat. No. 5,497,006, only the output voltage of the filament power supply unit is controlled. As a result, an increase in the filament impedance produces a reduction in filament current and a corresponding reduction in the power delivered to the filament. No provision is made for internal compensation for this change in filament impedance to maintain filament power. Instead in the prior art U.S. specification, the reduction in filament power will presumably produce an increase in the cathode bias impedance producing in turn a reduction in cathode bias current which will eventually produce an increase in the voltage demand signal applied to the filament power supply to compensate. However, the control loop disclosed in the prior art U.S. patent requires a reduction in the cathode bias current, and therefore power delivery to the cathode, which can in turn effect the plasma arc in the main arc chamber of the ion source.

The above apparatus may conveniently be used with a filament power supply unit which provides a filament voltage feedback signal representing the output voltage of the filament supply unit and a filament current feedback signal representing the output current filament supply unit, the filament supply controller then including a filament multiplier deriving a filament power feedback signal from the product of said filament voltage and filament current feedback signals, a filament power comparator deriving a filament power error signal from the difference between said filament power feedback signal and said filament power demand signal, and a filament power conditioning filter including an integrator, to condition said filament power error signal to apply as an output control signal to said filament power supply unit to control the output of the supply unit to reduce said filament power error signal. Thus, there is provided an internal control loop which ensures the output power of the filament power supply is maintained at the demanded level.

The filament supply controller preferably includes a bias parameter error conditioning filter including an integrator to condition a bias parameter error signal to provide said filament power demand signal.

The bias power supply parameter used above may be the output voltage of said cathode bias power supply unit, in which case said error is the difference between said output voltage and a desired value of said output voltage. Instead the bias power supply parameter may be the output current of said cathode bias power supply unit, and then said error is the difference between said output current and a desired value of said output current.

Preferably, however, said bias power supply parameter is the impedance of the load supplied by the cathode bias power supply unit.

In a further aspect of the invention, there is provided power control apparatus for controlling power supplies of an indirectly heated cathode-type ion source as hereinbefore defined, having a filament power supply unit, a cathode bias power supply unit and an arc power supply unit, the apparatus comprising a filament supply controller responsive to a signal representing the impedance of the load supplied to the cathode bias power supply unit to adjust said filament supply to maintain said bias load impedance at a desired value. This filament supply controller may be used in combination with the above described bias supply controller, or independently.

By controlling the filament power supply to maintain the impedance of the cathode bias load constant, there is no need for a separate externally derived cathode command signal to provide control of the cathode bias load impedance. By maintaining the cathode bias load impedance substantially constant, even for variations in the required arc power, the gain in the power control loop for the cathode bias power supply can be kept more constant. Gain control and stability of the cathode bias power supply unit can be maintained up to maximum cathode bias power supply output. In practice, the controlled impedance value of the cathode bias load can be selected to match the maximum voltage and current output capability of the cathode bias power supply unit, so that full output capacity of the power supply can be utilised.

Thus, the above described apparatus may be used with a cathode bias power supply unit which provides a voltage feedback signal having a linear relationship to the output voltage to said load and a current feedback signal having a linear relationship to the output current to said load, and in which said linear relationship are such that the ratio of the output voltage to the output current is equal to said desired value of the bias load impedance when the feedback voltage signal value is equal to the feedback current signal value. Then, said filament supply controller may be responsive to minimise the difference between said feedback signal values. For this, the filament supply controller may include an impedance comparator deriving a bias load impedance error signal from the difference between the voltage feedback signal and current feedback signal from the cathode bias power supply unit.

BRIEF DESCRIPTION OF THE DRAWING

An example of the present invention will now be described with reference to the accompanying drawing which is a schematic diagram of an indirectly heated cathode-type ion source with separate filament, cathode bias and arc power supply units, and bias supply and filament supply controllers therefor.

DETAILED DESCRIPTION OF THE INVENTION

Referring to the drawing, an ion source 10 is represented schematically. The ion source 10 may have the form of the indirectly heated cathode-type ion source as disclosed in the above referred U.S. Pat. No. 5,497,006. Thus, the ion source 10 comprises an arc chamber 11 providing electrically conductive interior surfaces, an indirectly heated cathode element 12 and a separate filament 13.

An arc power supply unit 14 applies an arc potential between the cathode element 12 and the arc chamber wall 11, with the cathode member 12 biased negatively relative to the arc chamber wall 11. A cathode bias power supply unit 15 is connected to apply a cathode bias between the cathode member 12 and the filament 13, with the filament 13 biased negatively relative to the cathode member 12. A filament power supply unit 16 provides a DC heating current through the filament 13.

The cathode member 12 may be constituted as a cylinder 17 extending through an aperture 18 in a wall of the arc chamber 11 and having an inner end closed by a "button" 19. The filament 13 is located within the cylinder 17 near but spaced from the inner face of the button 19.

In operation, the entire ion source structure 10 is in an evacuated region. A supply of a desired feedstock gas is delivered to the interior of the arc chamber 11. The filament power supply unit 16 is controlled to supply sufficient power to the filament 13 for this to emit electrons thermionically. The cathode bias supply unit 15 is controlled to accelerate these emitted electrons to strike and deliver energy to the adjacent surface of the button 19 of the cathode member 12. This energy delivered to the button member 19 effectively heats the button member of the cathode 12 the heating power delivered to the cathode 12 is mainly dependent on the power delivered by the bias power supply unit 15.

The cathode member 12 is heated sufficiently so as in turn to emit electrons into the interior of the arc chamber. These emitted electrons are in turn accelerated by the electric field produced by the arc power supply unit 14. Collisions between these accelerated electrons and molecules of the feedstock gas within the arc chamber 11 tend to ionise these molecules, increasing the number of available electrons and producing a plasma arc within the chamber 11. The arc power supply unit 14 controls the current flowing in the plasma in the chamber 11.

In practice, a magnetic field may be provided within the arc chamber 11 to concentrate the plasma in a central region of the chamber. Arrangements for this purpose are well known in this art.

In order to function as an ion source, the arc chamber 11 has an aperture and ions created in the plasma within the arc chamber are extracted by an extraction electrode at a negative potential relative to the potential of the arc chamber 11. Again, arrangements for extracting ions from the arc chamber and producing a required ion beam are well known in this art and will not be described further here.

The arrangement described so far is similar to that disclosed in U.S. Pat. No. 5,497,006.

Each of the power supply units 14, 15 and 16 is a programmable power supply having a voltage demand input 20, 21, 22, which can be set to control the maximum output voltage of the respective power supply unit. Also, each of the power supply units has a respective current demand input 23, 24, 25, which can be controlled to set the maximum output current of the respective power supply unit. Thus, each power supply unit will respond to voltage demand and current demand signals at its respective inputs, to provide an output voltage corresponding to the voltage demand input, provided this does not result in the output current exceeding the current demand input. In practice, the programmable power supply unit 14, 15 and 16 are normally employed in either controlled current or controlled voltage modes. In the attached drawing, the power supplies are shown operating in controlled current modes and each has its respective voltage demand input set at the highest possible input level. In this mode, each power supply operates to set an output voltage sufficient to provide the demanded input current.

The voltage demand and current demand input signals to each of the power supply units can vary between zero volts, corresponding to zero output voltage or current as appropriate, and 5 volts, corresponding to full scale output voltage or current. In the present case, the arc power supply unit has an output voltage range from zero to 150 volts with an output current range from zero to 7 amps; the cathode bias power supply unit 15 has an output voltage range from zero to 600 volts and an output current range from zero to 2 amps, and the filament power supply unit 16 has an output voltage range from 0 to 7.5 volts and an output current range from zero to 80 amps.

Each of the power supply units 14, 15 and 16 also provides a voltage feedback signal on a line 26, 27, 28, respectively and a current feedback signal on a line 29, 30 and 31 respectively. These feedback signals also have a voltage range between 0 and 5 volts corresponding to the full scale range of the output voltage and current of the power supplies. Thus, when the cathode bias power supply unit 15 is delivering an output voltage of 600 volts and an output current of 2 amps, both the voltage feedback and the current feedback signals 27 and 30 are at 5 volts representing full scale.

The arc power supply unit 14 is controlled by an arc current demand signal (arc I demand) on current control input 23. The voltage control input 20 is set at full scale (5 volts). The cathode bias power supply unit 15 receives a current demand signal on its current control input 24 from a bias supply controller 32. The voltage control input 21 of the cathode bias power supply unit 15 is set at full scale (5 volts) The current control input 25 of the filament power supply unit 16 receives a current demand signal from a filament supply controller 33. The voltage control input 22 of the filament power supply unit 16 is held at full scale (5 volts).

The bias supply controller 32 receives control inputs comprising an arc voltage demand signal (arc V demand) on a line 34 and the voltage feedback signal from the arc power supply unit 14 on line 26. The filament supply controller 33 receives control inputs comprising the voltage feedback signal 27 from the cathode bias power supply unit 15 on line 35 and the current feedback signal 30 from the bias power supply unit 15 on line 36.

In the arrangement illustrated in the drawing, the only external control signals received by the system are the arc voltage demand on line 34 and the arc current demand on input 23.

The bias supply controller 32 provides power demand control to the cathode bias power supply unit 15. As explained above, the arc power supply unit 14 responds to the arc current demand on input 23 to provide sufficient output voltage from the power supply unit to produce an output current corresponding to the demanded current represented by arc I demand, so long as the voltage needed to produce this arc current is less than the full scale output voltage of the power supply unit, here 150 volts.

Assuming the ion source is operating with a plasma formed in the arc chamber 11, arc current can flow and the arc voltage required will depend on the impedance of the plasma. This output arc voltage on line 26 is compared in a comparator 37 with the required arc voltage represented by arc V demand on line 34. Any difference between the actual arc voltage and the required arc voltage produces an error signal on line 38, which is conditioned by a three term (Proportional Integral Derivative—PID) filter 39. The PID filter 39 includes an integrating term and produces a signal on line 40 which functions as a power demand signal for the cathode bias power supply unit 15.

A current demand signal on control input 24 of the cathode bias power supply unit 15 controls the power supply to provide an output voltage sufficient to produce the demanded output current between the filament 13 and the cathode member 12 in the ion source, so long as the required output voltage of the bias power supply unit does not exceed the full scale output voltage, here 600 volts. The values of output voltage and output current produced by the cathode bias power supply unit 15 are represented by respective feedback signals on lines 27 and 30 connected to a multiplying unit 41 which produces a signal on line 42 representing the product of the output voltage and output current, that is the output power of the cathode bias power supply unit 15. This power signal on line 42 is compared in a comparator 43 with the power demand signal on line 40. A bias power error signal on line 44 corresponds to any difference between the actual power delivered by the power supply unit 15 and the demanded power represented by the signal on line 40. This error signal is then conditioned by a further PID filter 45, which also incorporates an integrator, to produce the current demand signal supplied to the current control input 24 of the power supply unit 15.

The feedback loop illustrated in bias supply controller 32, operates to maintain the output power of the cathode bias power supply unit 15 substantially equal to the demanded power on line 40, which is in turn dependent on the difference between the demanded arc voltage and the actual arc voltage delivered by the arc power supply unit 14. As can be seen, the cathode bias power supply unit 15 has in effect an internal power control loop which serves to maintain the power delivered by the bias power supply unit 15 to the cathode bias load substantially constant, irrespective of possible changes in the impedance of this load, as may occur due to change in chemistry within the arc chamber of the ion source, changes in gas pressure, or physical changes in the cathode structure.

The PID filter 45 in the power control loop of the bias supply controller 32 can provide a very fast response since the cathode bias load, formed by the electron flow between the filament 13 and the button 19 of the cathode member 12, has no significant thermal inertia. As a result, the power control loop of the bias supply controller 32 ensures that the effective power delivered to the cathode responds very quickly both to any change in the cathode bias load impedance, and to any change in the power demand on line 40, resulting from a change in the arc parameters.

In this way, the arc in the plasma chamber (between the cathode member 12 and the plasma chamber walls 11) can be controlled accurately with a very short time constant.

As mentioned above, various changes in the ion source may result in changes in the cathode bias load impedance. The filament supply controller 33 operates to control the power delivered to the filament 13 so as to minimise any such variations in the cathode bias load impedance. However, because of the thermal inertia of the filament 13, the filament supply controller 33 operates with a relatively slower response to maintain stability.

In the described example, the cathode bias power supply unit 15 is arranged so that the full scale output voltage of the supply unit divided by the full scale output current of the supply unit is equal to the desired cathode load impedance, corresponding to 300 ohms in the present example. Since the voltage and current feedback signals on lines 27 and 30 from the cathode bias power supply unit 15 provide full scale values of 5 volts corresponding to the above full scale voltage and current values, it can be seen that the load impedance on the cathode bias power supply unit 15 is always 300 ohms if the voltage feedback signal on line 27 is equal to the current feedback signal on line 30.

These current and voltage feedback signals are supplied on lines 35 and 36 to a comparator 46 in the filament supply controller 33. An error signal on line 47 corresponds to any difference between these current and voltage feedback signals, and therefore corresponds to an error in the load impedance of the cathode bias power supply unit 15, when this impedance differs from 300 ohms (in the present example). This error signal on the line 47 is supplied to a further PID filter 48 which includes an integrator and supplies on a line 49 a filament power demand signal.

The filament voltage feedback signal on line 28 and the filament current feedback signal on line 31 are supplied to a multiplier unit 50 in the filament supply controller 33, which produces a signal on a line 51 representing the product of the output voltage and output current of the filament power supply unit 16 and hence the power output of the supply 16. This power signal on line 51 is compared in a comparator 52 with the power demand signal on line 49. A signal representing any difference between the actual power and the demanded power of the filament power supply unit 16 is supplied on a line 53 to a further PID filter 54 including an integrator, which produces a current demand signal for supply to the current control input 25 of the filament power supply unit 16.

In this way, the current supplied by the power supply unit 16 is adjusted so that the total power from the filament power supply unit 16 corresponds to the demanded power on line 49. This demanded power on line 49 in turn is such as to maintain the cathode bias load impedance at the predetermined constant value (here 300 ohms).

As mentioned above, the PID filters 48 and 54 in the filament supply controller 33 are arranged to be relatively slower acting, to match the time constant of the filament 13 resulting from the thermal inertia of the filament.

Importantly, any change in the impedance of the filament 13 is automatically compensated for by the internal power control loop in the filament supply controller 33.

Further, by controlling the filament power to maintain the cathode bias impedance constant, the cathode bias power supply unit 15 can operate over a wide output power range without saturating.

Importantly also, there is no need for any external control signals to the supply controllers in addition to arc V demand and arc I demand.

The above example of the invention has been described with reference to individual components such as comparators, PID filters and multipliers. However, the functions of both the bias supply controller 32 and the filament supply controller 33 can be embodied as a Digital Signal Processor suitably programmed to provide the required functions as described above.

Although in the above example the arc power supply unit 14 receives an arc current demand signal on current control input 23 and the resulting arc voltage is then compared with the arc voltage demand signal in a comparator 37 of the bias supply controller 32, these two operations could be reversed. Thus, the arc voltage demand could be supplied directly to the voltage control input 20 of the arc power supply unit 14, with the current control input 23 held at the full scale 5 volts. Then the current feedback signal on line 29 is compared with the arc current demand to control the cathode bias supply unit 15.

Similarly, although the above described example has the current control input 24 of the cathode bias power supply unit 15 controlled by the bias supply controller 32, and the voltage control input 21 held at full scale 5 volts, these two controls could be reversed so that the current control input is held at 5 volts and the control input from the bias supply controller 32 is supplied to the voltage control input 21.

Again the control inputs 22 and 25 of the filament power supply unit 16 could also be reversed.

What is claimed is:

1. Power control apparatus for controlling power supplies of an indirectly heated cathode-type ion source, the apparatus comprising a bias supply controller responsive to a difference between a parameter of the arc power supply and a demand value of said parameter to produce a bias power demand signal representing an output power of the cathode bias power supply unit required to minimise said difference and is further responsive to said bias power demand signal to maintain said output power of said cathode bias power supply unit at said required power.

2. Apparatus as claimed in claim 1, wherein said arc power supply parameter is the output voltage of said arc power supply unit.

3. Apparatus as claimed in claim 1, wherein said arc power supply parameter is the output current of said arc power supply unit.

4. Apparatus as claimed in claim 1 for use with a cathode bias power supply unit which provides a bias voltage feedback signal representing the output voltage of the supply unit and a bias current feedback signal representing the output current of the supply unit, wherein the bias supply controller includes a bias multiplier deriving a bias power feedback signal from the product of said bias voltage and bias current feedback signals, a bias power comparator deriving a bias power error signal from the difference between said bias power feedback signal and said bias power demand signal, and a bias power error conditioning filter, including an integrator, to condition said bias power error signal to apply as an output control signal to said cathode bias power supply unit, to control the output of the supply unit to reduce said bias power error signal.

5. Apparatus as claimed in claim 1, wherein said bias supply controller includes an arc parameter comparator deriving an arc parameter error signal from said difference between said arc parameter and said demand value of said arc parameter, and an arc parameter error conditioning filter, including an integrator, to condition said arc parameter error signal to provide said bias power demand signal.

6. Apparatus as claimed in claim 1, wherein the apparatus further comprises a filament supply controller responsive to an error in a parameter of the bias power supply relative to a desired value of said parameter to produce a filament power demand signal representing an output power of the filament power supply unit required to minimise said error and is further responsive to said filament power demand signal to maintain said output power of said filament power supply unit at said required power.

7. Power control apparatus for controlling power supplies of an indirectly heated cathode-type ion source having a filament power supply unit, a cathode bias power supply unit and an arc power supply unit, the apparatus comprising a filament supply controller responsive to an error in a parameter of the bias power supply relative to a desired value of said parameter to produce a filament power demand signal representing an output power of the filament power supply unit required to minimise said error and is further responsive to said filament power demand signal to maintain said output power of said filament power supply unit at said required power.

8. Apparatus as claimed in either of claim 6, for use with a filament power supply unit which provides a filament voltage feedback signal representing the output voltage of the filament supply unit and a filament current feedback signal representing the output current of the filament supply unit, wherein the filament supply controller includes a filament multiplier deriving a filament power feedback signal from the product of said filament voltage and filament current feedback signals, a filament power comparator deriving a filament power error signal from the difference between said filament power feedback signal and said filament power demand signal, and a filament power conditioning filter including an integrator, to condition said filament power error signal to apply as an output control signal to said filament power supply unit to control the output of the supply unit to reduce said filament power error signal.

9. Apparatus as claimed in claim 6, wherein said filament supply controller includes a bias parameter error conditioning filter, including an integrator, to condition a bias parameter error signal to provide said filament power demand signal.

10. Apparatus as claimed in claim 6, wherein said bias power supply parameter is the output voltage of said cathode bias power supply unit, and said error is the difference between said output voltage and a desired value of said output voltage.

11. Apparatus as claimed in claim 6, wherein said bias power supply parameter is the output current of said cathode bias power supply unit, and said error is the difference between said output current and a desired value of said output current.

12. Apparatus as claimed in claim 6, wherein said bias power supply parameter is the impedance of the load supplied by the cathode bias power supply unit.

13. Apparatus as claimed in claim 1, wherein the apparatus further comprises a filament supply controller responsive to a signal representing the impedance of the load supplied by the cathode bias power supply unit to adjust said filament supply to maintain said bias load impedance at a desired value.

14. Power control apparatus for controlling power supplies of an indirectly heated cathode-type ion source having a filament power supply unit, a cathode bias power supply unit and an arc power supply unit, the apparatus comprising a filament supply controller responsive to a signal representing the impedance of the load supplied by the cathode bias power supply unit to adjust said filament supply to maintain said bias load impedance at a desired value.

15. Apparatus as claimed in claim 12, for use with a cathode bias power supply unit which provides a voltage feedback signal having a linear relationship to the output voltage to said load and a current feedback signal having a linear relationship to the output current to said load, and in which said linear relationships are such that the ratio of the output voltage to the output current is equal to said desired value of the bias load impedance when the feedback voltage signal value is equal to the feedback current signal value, wherein said filament supply controller is responsive to minimise the difference between said feedback signal values.

16. Apparatus as claimed in claim 15, wherein the filament supply controller includes an impedance comparator deriving a bias load impedance error signal from the difference between the voltage feedback signal and the current feedback signal from the cathode bias power supply unit.

* * * * *